United States Patent [19]

Hehlen, deceased et al.

[11] Patent Number: 5,055,833

[45] Date of Patent: Oct. 8, 1991

[54] METHOD FOR THE CONTROL OF AN ELECTRO-OPTICAL MATRIX SCREEN AND CONTROL CIRCUIT

[75] Inventors: Robert Hehlen, deceased, late of Rabastens, by Laurent Hehlen, legal representative; by Philippe Hehlen, legal representative; by Bernard Hehlen, legal representative, both of Morgangis; Maurice Le Galguen, Palaiseau; Bruno Mourey, Boulogne Billancourt, all of France

[73] Assignee: Thomson Grand Public, Paris, France

[21] Appl. No.: 232,644

[22] Filed: Aug. 15, 1988

Related U.S. Application Data

[63] Continuation of PCT FR87/00405 filed Oct. 16, 1987.

[30] Foreign Application Priority Data

Oct. 17, 1986 [FR] France ..... 86 14413

[51] Int. Cl.[5] ..... G09G 3/00; G09G 3/36

[52] U.S. Cl. ..... 340/784; 340/805; 340/811

[58] Field of Search ..... 340/784, 805, 765, 811; 350/333; 358/241

[56] References Cited

U.S. PATENT DOCUMENTS

| | | | |
|---|---|---|---|
| 3,976,362 | 8/1976 | Kawakami | 340/805 |
| 4,191,955 | 3/1980 | Robert | 340/805 |
| 4,427,979 | 1/1984 | Clerc et al. | 340/805 |
| 4,645,303 | 2/1987 | Sekiya et al. | 340/805 |
| 4,715,688 | 12/1987 | Harada et al. | 350/333 |
| 4,779,085 | 10/1988 | Mizutome et al. | 340/805 |

*Primary Examiner*—Ulysses Weldon
*Assistant Examiner*—M. Fatahiyar
*Attorney, Agent, or Firm*—Roland Plottel

[57] ABSTRACT

A control method and control circuit for an electro-optic matrix screen wherein: a) during a frame time period, and during the control of certain lines, the screen is controlled by voltages of a determined polarity; b) during the same frame time period, and during the control of the other lines, the screen is controlled by voltages of reverse polarity; and c) during the following frame time period, the control voltages is reversed. An inverter control circuit C.INV enables the inversion of the voltages given by input circuits INV, IN, ADD.C to the column electrodes, and by an addressing circuit ADD.C to the line electrodes. The invention can be applied to the control of liquid crystal display panels to eliminate display faults.

6 Claims, 6 Drawing Sheets

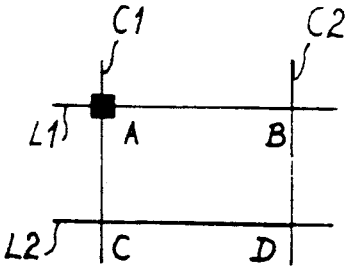
FIG_1
PRIOR ART
FIG_2
PRIOR ART
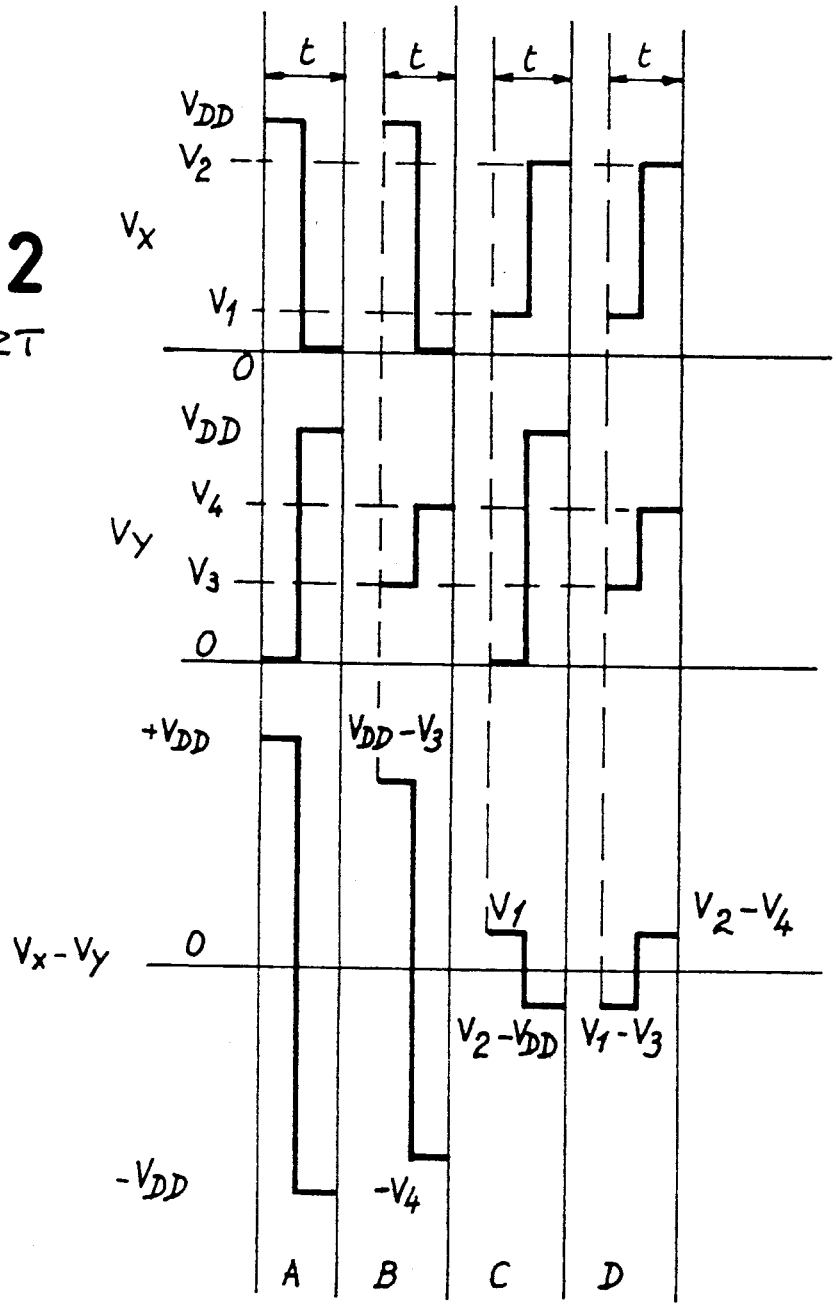

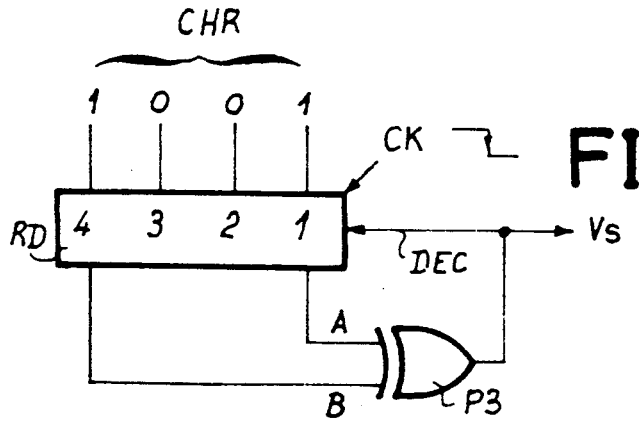
FIG_9
FIG_10
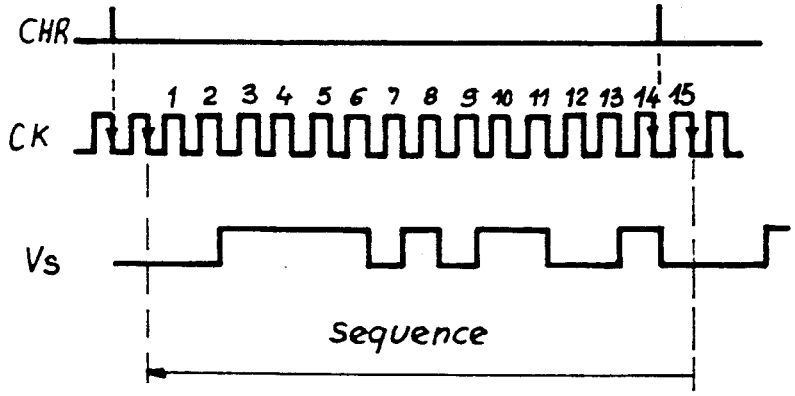
FIG_11
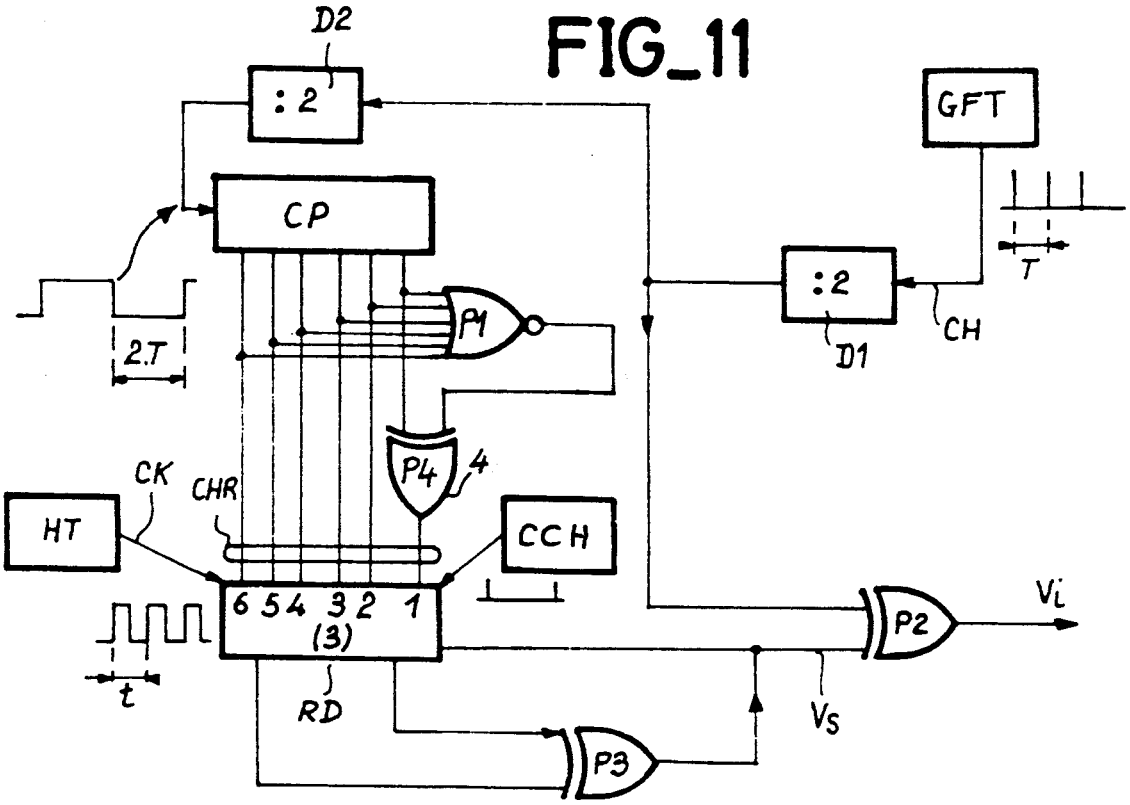

METHOD FOR THE CONTROL OF AN ELECTRO-OPTICAL MATRIX SCREEN AND CONTROL CIRCUIT

This application is a continuation under M.P.E.P. 1892, 35 U.S.C. 365 and 35 U.S.C. 120 of International patent application PCT/FR 87/00405 filed Oct. 16, 1987 in France and which designated the United States, which is application is incorporated herein by reference.

Priority under 35 U.S.C. 119 is claimed based on French patent application 86 14413 filed in France on Oct. 17, 1988.

The invention concerns a method to control an electro-optical matrix screen and a control circuit to implement this method. It can be applied especially to control liquid crystal panels in which the control voltages are periodically reversed.

At present, electro-optical display panels such as liquid crystal display panels are controlled by alternating signals in order to increase their lifetime. Since the control integrated circuits are, for economic reasons, unipolar, and are generally controlled between 0 volts and V volts, it is necessary to invert the phase of the control signals either at every line or at every frame to obtain $+V_{rms}$ and $-V_{rms}$ voltages at the terminals of the capacitor enclosing the electro-optical material.

To control an elementary screen such as the one shown in FIG. 1, comprising two lines L1, L2 and two columns C1, C2, and to illuminate the point A at the intersection of the line L1 and the column C1, and the functioning of the screen in control mode by inversion of lines is shown in FIG. 2. During the period t for the control of the points (A and B) of the line L1, a voltage $V_X$ with a value $+V_{DD}$ is applied to the line L1 for a first half of the period t. Simultaneously, the column C1 wire, which should enable the lighting up of the point A, is set at a potential $V_Y$ with a substantially zero value. The potential difference applied to the point A is therefore $+V_{DD}$ and the point A is lit up. The column C2 wire is taken to a potential $V_Y=+V_3$ giving a potential difference $+V_{DD}-V_3$ at the terminals of the point B, which is insufficient to light up this point. The line L2 wire, which is not controlled at this instant, receives a potential $+V_1$. The potential difference at the terminals of the point C is $V_1$ and that at the terminals of the point D is $V_1-V_3$. These points are not lit up.

During the second half of the period t, the line L1 receives a potential of $V_X=0$ volts, the line L2 receives a potential of $+V_2$. The column C1 receives a potential of $V_Y=+V_{DD}$, and the column C2 receives a potential of $V_4$.

The difference in potential at the terminals of the point A is $-V_{DD}$. This point is lit up. The differences in potential at the terminals of the points B, C and D are respectively $-V_4$, $V_{DD}-V_2$ and $V_{DD}-V_4$. These points are not lit up.

During the line L1 control period, the control has therefore been reversed. During the line 2 control period the operation would be similar.

The operation of the same screen in control mode by frame inversion is shown in FIG. 3. During a first frame, the potentials applied to the wires of lines L1 and L2 are $+V_{DD}$ and $+V_1$ while those applied to the wires of columns C1 and C2 are zero volts and $+V_3$.

The differences in potentials at the terminals of the points A, B, C and D are respectively $+V_{DD}$, $V_{DD}-V_3$, $+V_1$ and $V_1-V_3$. Only the point A is lit up.

In a second frame, the wires of lines L1 and L2 receive the 0 volts and $+V_2$ potentials, the wires of columns C1 and C2 receive the potentials $+V_{DD}$ and $V_4$. The differences in potentials at the terminal of the points A, B, C and D are respectively $-V_{DD}$, $-V_4$, $V_{DD}-V_2$ and $V_{DD}-V_4$. Only the point A is still lit.

Thus, a control by frame inversion has been achieved. However, when a screen with a high multiplexing rate is observed, namely a screen with a number of lines N greater than 32 it is noted that, in both control modes, display faults are obtained.

In the control mode with line reversals, it is observed that, in the columns where a point is lit up, the other points are slightly excited. In the example of FIG. 4 where the point of A is lit up and becomes black, the point C is also excited and becomes grey when it should have remained white like the points B and B.

In the control mode with frame inversion, the point A is black since it is lit up. The column C2 should not have any excited point, and yet it is observed, as shown in FIG. 5, that the points B and D are grey.

These anomalies are due to reversals of voltage which give rise to transients during each image period, and unwanted voltages result from this. These display faults are troublesome for vision because they persist for as long as certain columns comprise no addressed words, and they persist long enough for the observer to distinguish them sharply. Faults of this type are visible for screens with more than 32 lines and for which the time duration of the frame is about 20 ms.

The object of the invention is to obtain an image which brings out the data to be displayed on a homogeneous background. For example, as shown in FIG. 6, the set goal will be to obtain an image in which the point A is black and the points B, C and D are all white or even all grey (but with the same shade of grey). The invention therefore concerns a method for the control of an electro-optical matrix screen comprising several cells arranged in lines and columns, each cell being provided with control electrodes, providing for the application, to the control electrodes of each cell, of at least one first control voltage with a first determined sign and at least one second control voltage with a second sign opposite the first one, characterized in that:

the lines of the cells being controlled during the line time intervals, said time intervals may be of a first type or a second type; during a determined frame period and during the intervals of the first type, the lines of cells are controlled by said first control voltage and, during the intervals of the second type, the lines of the frames are controlled by said second voltage;

during the following frame and during the intervals of the first type, the lines of cells are controlled by a second voltage while, during the intervals of the second type, the lines are controlled by said first voltage.

The invention also relates to a control circuit of an electro-optical screen that implements the above method:

a liquid crystal display panel comprising cells arranged in lines and columns, each cell being controlled by a line electrode and a column electrode with the screen comprising a determined number of lines;

power supply circuits used to give at least one first control voltage of a first determined sign and at least one second control voltage of a second sign opposite to that of the first sign;

an inverter circuit used to apply, to said line and column electrodes, either the first control voltage or the second control voltage;

a line period clock determining the control period of each line;

a frame frequency signal generator determining the display period of a frame;

characterized that it further comprises:

a generator of N random codes, which are all different, equal in number to the number N of lines, connected to the inverter circuit and enabling, depending on the value of each code, the command of the inverter circuit so that it applies, at each line to be controlled, during each line period, either the first control voltage or the second control voltage;

a first frequency divider by two receiving the frame frequency signal and giving a switch-over signal, during one frame in two, to the inverter circuit to invert the functioning of this inverter circuit.

The various objects and characteristics of the invention will emerge more clearly from the following description, made with reference to the appended figures, of which:

FIG. 1 is an elementary display screen of the prior art;

FIG. 2 is a diagram showing the operation of the screen of FIG. 1 in control mode by line inversions according to the prior art, already described above;

FIG. 9 is an example of a pseudo-random control circuit;

FIG. 10 is a graph of the operation of the circuit of FIG. 8;

FIG. 11 is a detailed example of a control circuit according to the invention;

Figure 3:
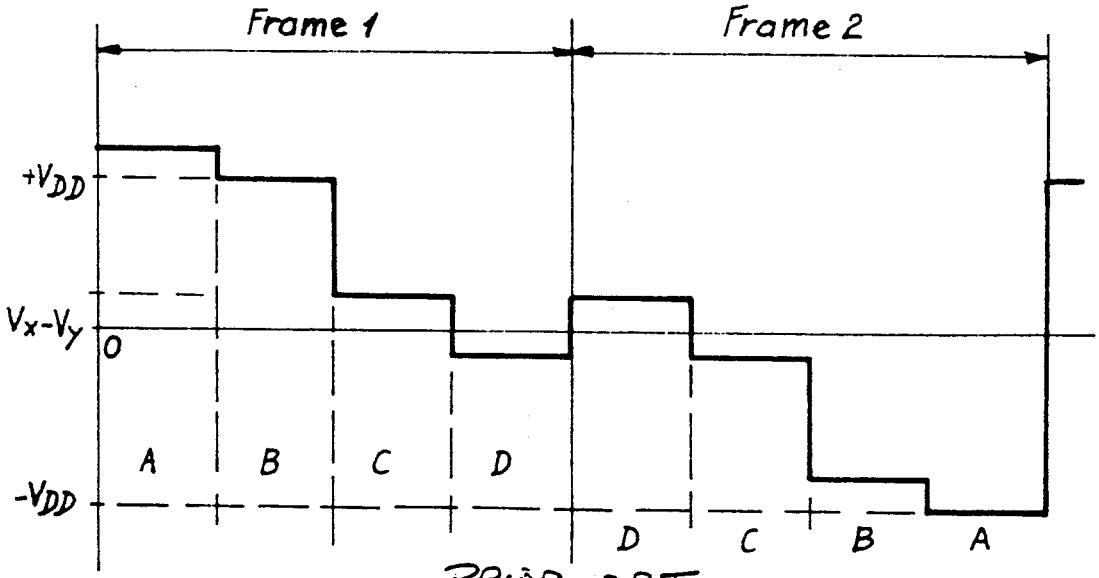
FIG. 3 is a graph of the operation of the screen of FIG. 1 in control mode by frame inversion according to the prior art, and already described above.
Figure 4:
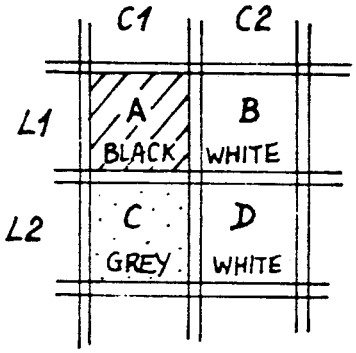
PRIOR ART FIG 4
FIGS. 4 and 5 are examples of images obtained on prior art screens.
Figure 5:
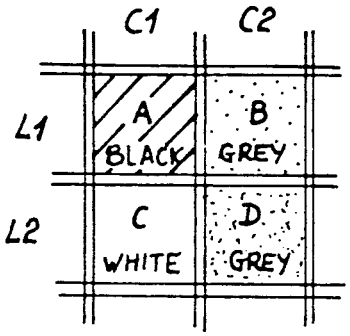
PRIOR ART FIG 5
Figure 6:
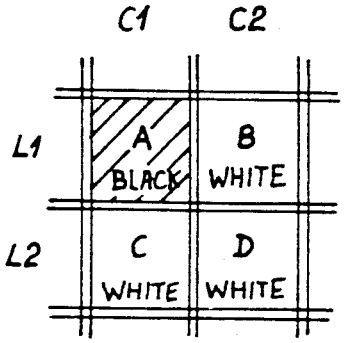
PRIOR ART FIG 6
FIG. 6 shows an example of an image obtained on a screen controlled according to the method and circuit of the invention.

As seen earlier, with reference to FIGS. 1, 2 and 3, it is possible to modify the control voltages of the pixels of the screen during each line period.

It is also possible to modify these control voltages from one frame to the next one. However, known systems give rise to display faults as described earlier.

To prevent these faults, the method of the invention provides, during a frame period T corresponding to the display of an image on the screen and having distributed this frame period into intervals of line periods t, for distinguishing, in these intervals of line periods, intervals of a first type ta and intervals of a second type tb.

During a first frame T1 and during the time intervals ta of the first type, the control of the screen is such that the voltage at the terminals of each cell (or point) of the image has a determined value and a polarity which is also determined, positive for example.

Returning to the examples of polarity used in the descriptions of FIGS. 1 and 2, according to the invention a line, which should give rise to the display of data during a period ta receives a potential $+V_{DD}$.

Figure 13:
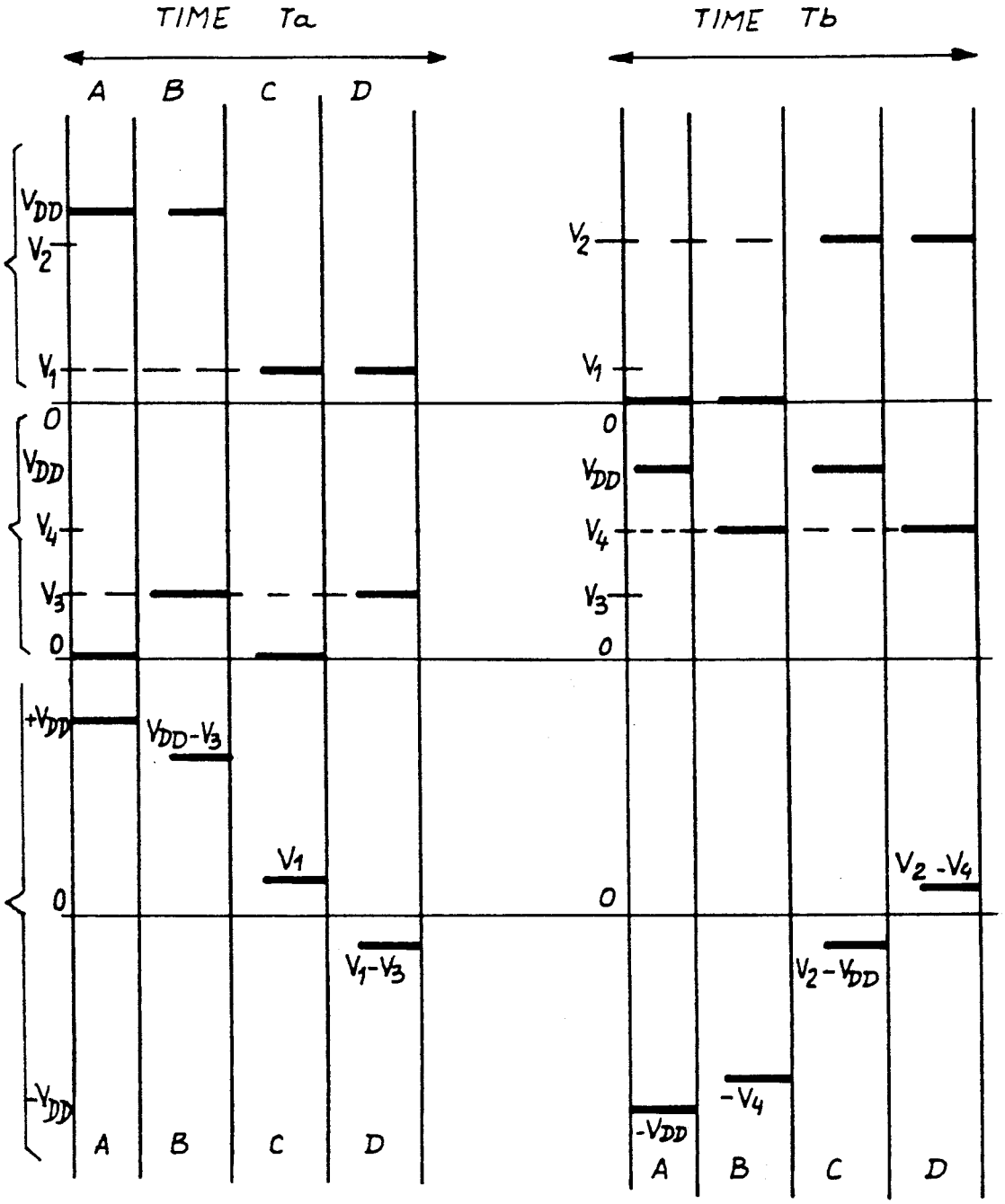
FIG. 13 is a graph of the operation of the method of the invention.

The other lines (L2), which should not give rise to the display of data, receive a potential $+V_1$ (see FIG. 13). The columns, such as C1, for which the intersection with the line to be controlled (L1) gives rise to the lighting a point, receive a potential of 0 volts and the intersection point (A) is subjected to a difference in potentials $+V_{DD}$.

The other columns (C2) receive a potential $+V_3$ and the points of intersection (B) with the controlled line (L1) are subjected to a difference in potentials $V_{DD}-V_3$.

In FIG. 13, it can thus be seen that the other points of intersection C and D are respectively subjected to differences of potential of $V_1$ and $V_1-V_3$.

The other lines of the screen are controlled in display either for a type ta period as has just been described or during a type tb period as shall now be described.

For, during a second frame T2, the potentials used during the period ta are those used during the period tb of the previous frame and conversely. This means that, when describing a period of ta of the frame T2, a period tb of the frame T1 is described at the same time.

The display of the line L1 which has just been described will therefore now be done with different potentials and, to display the same piece of information on the screen, the control should be like the one shown at the right-hand part of FIG. 13. The potentials applied are:

on the line L1: 0 volts;

on the line L2: $+V_2$;

on the column C1: $+V_{DD}$;

on the column C2: $+V_4$.

The differences in potentials applied to the various points of intersection are then:

for the point A: $-V_{DD}$ for the point B: $-V_4$ for the point C: $V_2-V_{DD}$ for the point D: $V_2-V_4$ It is thus seen that the polarities of the voltages are inverted between the periods ta and tb and from one frame to the next one, because of the switching over of the voltages from the period ta to the period tb and, reciprocally, the control of each line is reversed. During a third frame, the operation then becomes identical to that of the first frame and, during a fourth frame, the operation again becomes identical to that of the second frame and so on, with the utility of the two types of periods ta and tb being alternated from one frame to the next one.

The various periods of lines of each frame are distributed randomly into intervals of periods of the first type ta and intervals of periods of the second type tb. But it is also possible to provide for substantially equal numbers of periods ta and periods tb.

Figure 7:
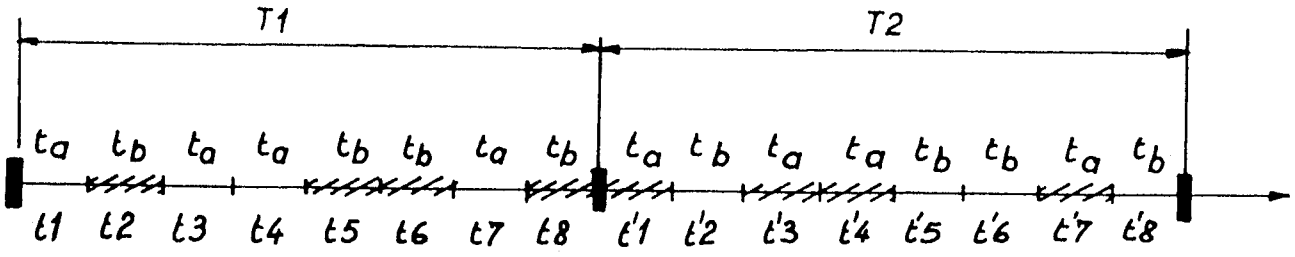
FIG. 7 is a graph representing two frame periods according to the invention.

FIG. 7 shows two consecutive frame periods T1 and T2. Each frame period comprises, for example, 8 line periods t1, t8 for the frame period T1 and eight periods t'1 to t'8 for the frame period T2. These periods are distributed into periods of the first type ta and periods of the second type tb in such a way that each second frame T2 is of the same type as the period of the same rank of the first frame T1.

According to the example shown, the periods t1, t3, t4, t7 of the frame T1 and t'1, t'3, t'4, t'7 of the frame T2 are of the first type, the periods t2, t5, t6 and t8 of the frame T1 and t'2, t'5, t'6, t'8 of the frame T2 are of the second type.

During the frame T1 and during the periods of the first type ta shown in FIG. 7 without hachured lines, the screen is controlled as shown in the left-hand side of FIG. 13 and, during the periods of the second type tb, which are hachured in FIG. 7, the screen is controlled as shown in the right-hand side of FIG. 13.

During the frame T2, the periods of the first type ta and of the second type tb are used in contrary ways. This is why the periods ta of the frame T2 are hachured and the periods tb are not hachured.

According to the invention, there is also provision for modifying the distribution of periods of the first type ta and of the second type tb every two frames. The system works as shown in FIG. 7 for two frames and then the distribution of the periods ta and tb is modified to work during the two following frames with a new distribution of the periods ta and tb, and so on. Thus, the existence of any display faults can only be transient and cannot be troublesome for an observer.

Figure 8:
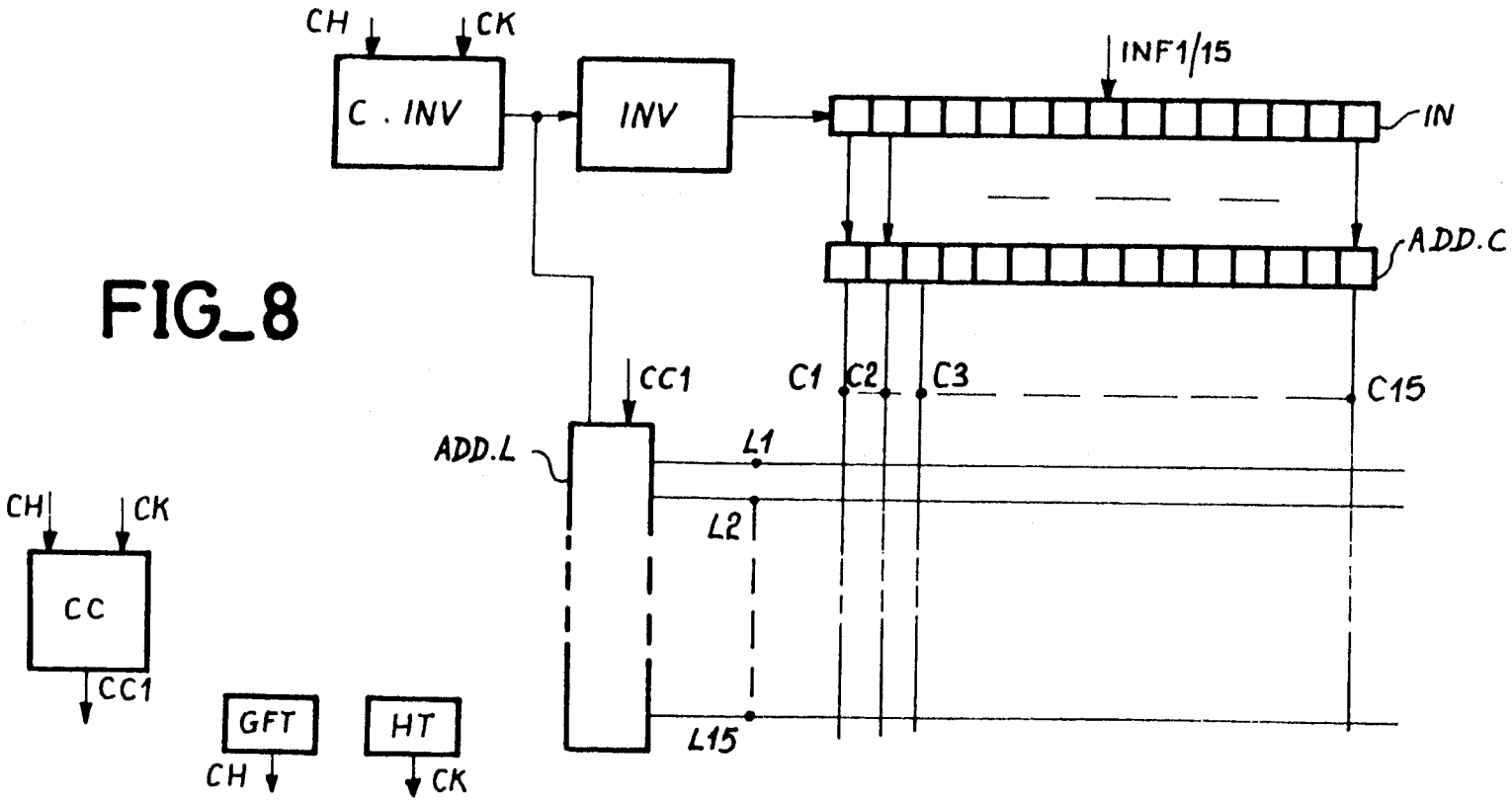
FIG. 8 is an example of a control circuit of a liquid crystal display panel according to the invention.

Referring to FIG. 8 we shall now describe an example of a circuit that implements the method of the invention.

An electro-optical screen such as liquid crystal display panel CL has been shown with its line electrodes and column electrodes. To simplify the description, the figure shows a screen comprising only 15 line electrodes L1 to L15 and 15 column electrodes C1 to C15.

The line electrodes L1 to L15 are controlled and powered by an addressing circuit ADD.L.

The column electrodes C1 to C15 are controlled and powered by an addressing circuit ADD.C. This has been represented by a register comprising as many stages as there are column electrodes. This addressing register receives control data from an inverting register IN which gives a bit 0 or 1 for each column electrode. An inverter circuit IN.V is used to invert the contents of each stage of the inverting register IN. An inverting control circuit C.INV triggers the functioning of the inverting circuit INV.

These circuits are all placed under the control of a central circuit CC, the working of which is driven by a frame frequency generator GFT and a line period clock HT.

The operation of the circuits of FIG. 8 is as follows:

The clock HT gives a line period CK at regular intervals and controls the display by the circuit CC and the addressing circuit ADD.L (signal CC1), of a line of the screen by the application of a potential such as $+V_{DD}$ on the line to be displaced and a potential such as $+V_1$ on all the other lines on the matrix as described with respect to FIG. 2.

Furthermore, each line period signal CK controls the recording in the register IN of a piece of information INF 1/15 to be displayed on the line to be controlled.

This piece of information consists of as many binary elements 0 or 1 as there are column electrodes. These binary elements are transmitted to the column electrodes C1 to C15 by an addressing register ADD.C. Thus, at each line period signal, a piece of information INF 1/15 is displayed on the column electrodes C1 to C15.

The potentials supplied to the line electrodes and the column electrodes correspond to the potentials shown previously in the description of FIG. 13.

The inverter control circuit C.INV exerts pseudo-random control on control of the screen in ta type periods or in tb type periods. Under the control of this circuit C.INV, the circuit INV inverts the value of each binary element 0 or 1 contained in each stage of the register IN. The content of the addressing register ADD.C is also inverted in the same way and the potentials applied to the column electrodes C1 to C15 are also inverted. Simultaneously, the circuit C.INV controls the inversion of the line potentials applied to the line electrodes L1 to L15 in the addressing circuit ADD.L.

These inversions of potentials made in this way are done according to potential inversions decsribed with respect to FIG. 13.

The control circuit CC and the circuit C.INV permit an operation of this type throughout a frame period, the circuits C.INV controlling the switching over of the control voltages in passing from the period ta to tb and conversely.

During the following frame, triggered by a pulse CH, the circuit C.INV inverts the use of the periods ta and tb.

The circuit C.INV renews the operation of the screen for the two frames which follow the two frames that have just been displayed and so on.

According to an alternative embodiment of the invention, at the end of the display of the two frames that have just been displayed, the circuit C.INV alters the distribution of the periods of the first type ta and of the second type tb every two frames.

FIG. 9 shows an embodiment of the inverter control circuit C.INV made in the form of a pseudo-random sequences generator. It has a shift register RD. The number of stages of this register is such that the number of binary combinations that it gives covers the number of lines of the liquid crystql display panel. For a liquid crystal display panel with fifteen lines, a register with four stages is therefore taken. This register has four inputs, four outputs, one shift input (VEC) and one clock input (CK).

Certain outputs of the register RD are connected to an Exclusive-OR type gate P3. For example, the FIG. 9 has a gate with two inputs to which are connected the outputs of the stages 1 and 4 of the register RD. This gate gives a level 1 signal when its two inputs are at different logic levels (one at level 0 and the other at level 1). It gives a level 0 signal when both inputs are at the same logic level (either 0 or 1).

This output signal is applied to the shift input DEC of the register RD. It is also given provided on a link $V_S$ to be used as the inverter control signal.

At the start of the operation, the register RD receives a loading word CHR at its inputs, for example, the word 1001 as shown in FIG. 9. From this word, the content of the register RD takes a different value at each clock pulse CK through a leftward shift of its content and through the input of a binary element 0 or 1 depending on the state of the gate P3 in the stage 1 of the register.

FIG. 10 shows a graph of the operation of the circuit of FIG. 9. A loading word CHR is loaded as shown in FIG. 10. The register RD receives the various clock pulses CK. A signal is then obtained at the output of $V_S$ with the shape shown on the line $V_S$ of FIG. 10.

The values of the signals $V_S$ of the logic level 1 would control, for example, the control of the screen by positive voltages and the values of the signal $V_S$ of the logic level 0 would control the control of the screen by negative voltage.

This operation occurs during one frame. During the following frame, it is therefore necessary to invert the signal $V_S$.

The detailed circuits of FIG. 11 enable the inmplementation of this operation on several frames. FIG. 11 again shows the register RD which is shown herein with six stages instead of four and the gate P3.

The frame generator GFT gives a frame frequency signal CH to a frequency divider D1 by 2. This divider D1, during the different successive frames, alternately gives a level 1 signal and a level 0 signal. This signal is applied to gate P2 of the exclusive-OR type possessing two inputs and receiving also the inversion control signal. The gate P2 therefore gives an inversion control signal which is identical to the signal $V_S$ when the divider D1 gives a level 0 signal and which inverts the signal $V_S$ when the divider D1 gives a level 1 signal.

Figure 12:
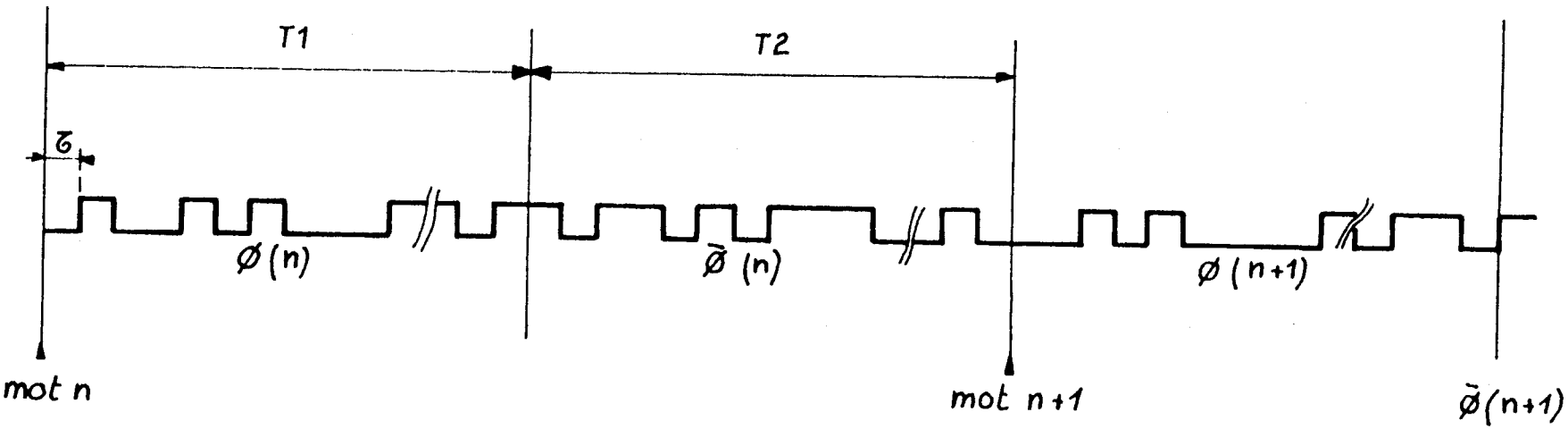
FIG. 12 is a graph of the operation of the circuit of FIG. 11.

In this way, as shown in the graph of FIG. 12, the circuits of FIG. 10 are used to implement the method of the invention as described above.

The circuits of FIG. 11 further make it possible to change the loading word CHR, given to the register RD during operation.

For this, a counter CP, having as many outputs as the register RD has inputs, gives a loading word to the register RD.

A frequency divider D2 by two receives the signal given by the digider D1. It commands the feed of the counter CP every two frames. At each feed of the counter CP, the loading word CHR changes value. Thus, the loading word CHR given to the register RD remains the same for two frames enabling inverted operation on two frames as explained above. During the following two frames, this operation is done with a different loading word. It will be noted that a loading word with a value 000000 would lead to a blocking of the register RD in this position. The circuits of FIG. 11 therefore provide for the detecting of a word of this type given by the counter CP and for forcing the register RD into a position different from 000000. This detection and forcing can be done as follows:

The detection is done by a gate P1 of the NAND type with six inputs connected to the outputs CP, the output of which is connected to an exclusive-OR type gate P4. The forcing is done by the gate P4 which receives an output signal from the counter CP and the output signal of the gate P1. The gate P4 controls an input of the register RD.

It is clear that the above description is given only as an example. The types of circuits (gates, registers, counters) especially, as well as the number of lines and columns of the screen can be different without going beyond the scope of the invention.

We claim:

1. A control circuit of an electro-optical screen implementing a method for the control of an electro-optical matrix screen comprising several cells arranged in lines and columns, each cell being provided with a line control electrode and a column control electrode providing for the application, to the control electrodes of each cell, of at least one first control voltage with a first determined sign and at least one second control voltage with a second sign opposite the first one, said method having frame time periods with line time intervals, characterized in that: first and second lines of the cells being controlled during the line time intervals, during a determined frame period and during the first line time intervals the lines of cells are controlled by said first control voltage and, during the second line time intervals the lines of the cells are controlled by said second control voltage; during the following frame period and during the first line time intervals the lines of cells are controlled by the second control voltage while, during the second line time intervals the lines are controlled by said first control voltage comprising:

a liquid crystal display panel comprising said screen and having said cells arranged in lines and columns, each cell being controlled by said line control electrode and column control electrode, with the screen comprising a determined number N of said lines; said circuit further comprising, power supply circuits for giving said first control voltage of said first determined sign and said second control voltage of said second sign opposite to that of the first sign; an inverter circuit for applying to said line and column electrodes, either the first control voltage or the second control voltage; a line period clock determining a control period of each line; and providing a line period clock signal to the inverter; a frame frequency signal generator determining a display period of a frame and providing a frame frequency signal; characterized in that said control circuit further comprises: a generator of random codes, which are all different and equal in number to the number N of lines, connected to the inverter circuit and enabling, depending on the value of each code, the control of the inverter circuit so that it applies, at each line to be controlled, during each line period, and controlled by the line period clock signal, either the first control voltage or the second control voltage; a first frequency divider-by-two circuit for receiving the frame frequency signal and giving a control signal, during one frame time period in two, to the inverter circuit for inverting the functioning of the inverter circuit.

2. A control circuit according to claim 1 characterized in that the random codes generator comprises:

a shift register (RD) comprising as many outputs as needed to give a number (N) of codes equal to the number (N) of lines;

a combinational logic circuit connected to the outputs of this register detecting certain values of determined codes and giving a binary signal 0 or 1 which is reinjected into a shift input of the register and which is given to the inverter circuit to control, depending on the binary value of the signal, the supply of either the first control voltage or the second control voltage.

3. A control circuit according to claim 2 characterized in that it comprises an exclusive-OR logic gate with two inputs receiving said binary signal at one input and said control signal at the other input, and giving, at an output, an inversion control signal to the inverter circuit, of which the various successive signals, given during a frame, time period are inverted with respect to the same sequences of a neighboring frame time period.

4. A control circuit according to claim 2 characterized in that the combinational logic circuit is an exclusive-OR gate comprising a number of inputs connected to two outputs of the shift register (RD).

5. A control circuit according to claim 4 characterized in that the exclusive-OR gate comprises two inputs connected to two outputs of the shift register.

6. A control circuit according to claim 1 further comprising:

a binary counter having as many outputs as the shift register has stages and having said outputs connected to inputs of the shift register;

a load control register connected to the first frequency divider, receiving the switch-over signal and controlling, at each transition of the switch-over signal, loading of the content of the binary counter in the shift register; and a second frequency divider-by-two circuit for receiving said switch-over signal and giving a feed signal to the binary counter.

* * * * *